United States Patent [19]

Tsumuraya et al.

[11] Patent Number: 4,526,489

[45] Date of Patent: Jul. 2, 1985

[54] PRINTER HOUSING WITH WEB TENSIONING MEANS

[75] Inventors: Kenichi Tsumuraya; Toshiaki Furuya, both of Tokyo, Japan

[73] Assignee: Seikosha Co., Ltd., Tokyo, Japan

[21] Appl. No.: 578,864

[22] Filed: Feb. 10, 1984

[30] Foreign Application Priority Data

Feb. 10, 1983 [JP] Japan ..... 58-21175

[51] Int. Cl.[3] ..... B41J 29/02

[52] U.S. Cl. ..... 400/693; 400/618; 400/645.4; 400/689; 181/200

[58] Field of Search ..... 400/618, 645.4, 647.1, 400/679, 689, 690, 690.4, 691, 693, 713, 719; 181/198, 200, 201

[56] References Cited

U.S. PATENT DOCUMENTS 3,050,171 8/1962 Baumgartner ..... 400/713 X
3,122,228 2/1964 Dollenmayer et al. ..... 400/690
4,173,420 11/1979 Okabe ..... 400/618
4,340,315 7/1982 Teichmann et al. ..... 400/690.4

FOREIGN PATENT DOCUMENTS 0038065 10/1981 European Pat. Off. ..... 400/689
2706209 8/1978 Fed. Rep. of Germany ..... 400/690

*Primary Examiner*—Clifford D. Crowder
*Assistant Examiner*—James R. McDaniel
*Attorney, Agent, or Firm*—Robert E. Burns; Emmanuel J. Lobato; Bruce L. Adams

[57] ABSTRACT

A housing for an impact printer has a case body and a cover thereof. They define therebetween an opening for the passage of the paper to be printed and the printed paper. A paper shelf lies over the top surface of the case body, and supported at one end rotatably away from the case body. The end of the paper shelf is located in the vicinity of the opening, and spaced apart from the case body and the cover only to the extent required for the passage of the paper to be printed and the printed paper. The top surface of the case body has at least one projection extending transversely of the paper to be printed. The paper shelf has a lower surface facing the top surface of the case body and formed with at least one projection extending transversely of the paper to be printed. This projection is spaced apart from the projection on the case body longitudinally of the paper to be printed. The projection of the paper shelf has a lower extremity lying at a level below the upper extremity of the projection on the case body.

9 Claims, 5 Drawing Figures

PRINTER HOUSING WITH WEB TENSIONING MEANS

BACKGROUND OF THE INVENTION

1. Field of the Invention

This invention relates to a housing for an impact printer.

2. Description of the Prior Art

The Known printer makes a considerably large noise during the printing operation. The printer includes a housing having an opening through which recording paper is loaded into the housing and unloaded therefrom. This opening is an outlet for the greater part of the noise. If the opening is narrowed, it is possible to reduce the leakage of the noise to some extent, but then it is difficult to set the recording paper in position.

SUMMARY OF THE INVENTION

It is, therefore, an object of this invention to provide a housing for a printer which can drastically reduce the leakage of the noise of the printing operation without sacrificing the ease of paper setting.

This object is attained by a printer housing comprising a case body and a cover therefor defining an opening for taking in and discharging recording paper, characterized by the provision of a paper shelf extending into the opening and lying over the top of the case body to separate a printed paper portion from an unprinted paper portion, the paper shelf being supported at one end in the vicinity of the opening rotatably away from the top of the case body, the paper shelf having a lower surface provided with at least one projection facing the top surface of the case body and extending transversely of the recording paper, while the top surface of the case body is provided with at least one projection facing the paper shelf, extending transversely of the recording paper and spaced apart from the projection of the paper shelf longitudinally of the recording paper, the projection of the paper shelf having a lower extremity lying below the upper extremity of the projection of the case body.

The printer including the case of this invention is advantageous for installation in an office or like place in which silence is greatly desired, since the case effectively reduces the leakage of the noise producing during the printing operation. The printer case is simple in construction and inexpensive to manufacture.

DETAILED DESCRIPTION OF THE INVENTION

Figure 1:
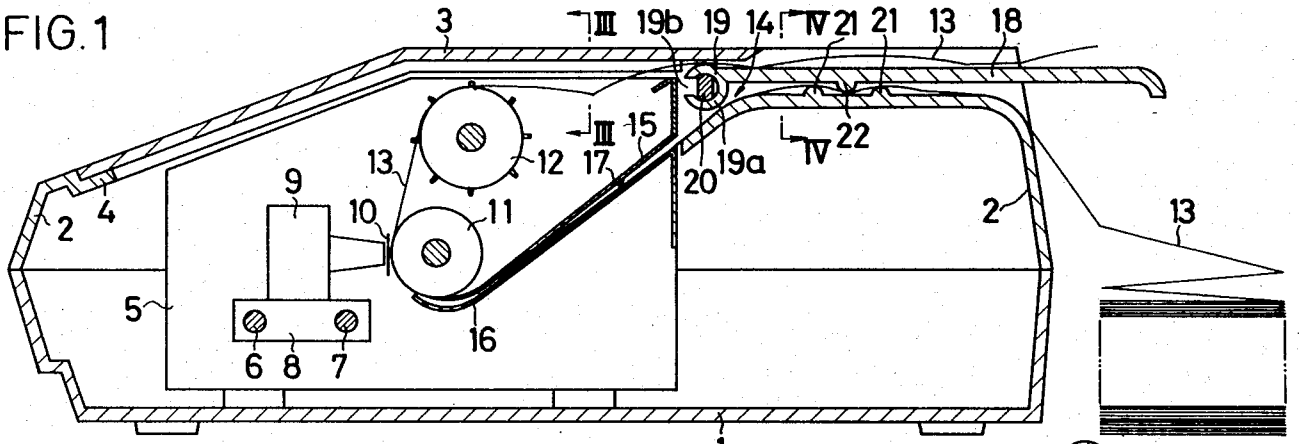
FIG. 1 is a sectional view showing a printer in which this invention is incorporated.
Figure 3:
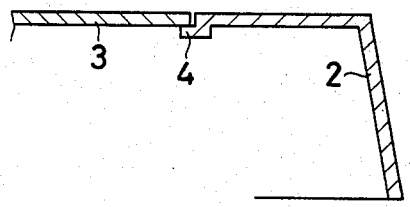
FIG. 3 is a sectional view taken along the line III—III of FIG. 1.

A printer housing embodying this invention is shown in FIG. 1, together with various parts of a printer. The case comprises a case body formed by a lower case portion 1 and an upper case portion 2. The upper case portion 2 is open at its top, and normally closed by a cover 3. The upper case portion 2 has a shoulder 4 surrounding its top opening. The cover 3 simply rests on the shoulder 4, as shown in FIGS. 1 and 3, and is removable. Alternatively, the cover 3 may be rotatably supported on the upper case portion 2 at one end, i.e., the left end thereof as viewed in FIG. 1.

Referring to the various printer parts in the case, a pair of guide shafts 6 and 7 extend between side plates 5, and a carriage 8 carrying an impact printing head 9 thereon is slidably supported on the guide shafts 6 and 7. A platen 11 faces the printing head 9, and an ink ribbon 10 lies between the printing head 9 and the platen 11. A pin wheel 12 is provided above the platen 11 for moving the recording paper. The top of the upper case portion 2 and the adjacent end of the cover 3 define therebetween an opening 14 through which the recording paper 13 is moved into and out of the case. Two guide members 15 and 16 are secured to the side plates 5 to define therebetween a passage 17 through which the recording paper 13 to be printed is fed into a clearance between the printing head 9 and the platen 11. After printing has been effected on the recording paper 13 by the printing head 9, the printed paper portion is fed out of the case by the pin wheel 12 through the opening 14.

According to a salient feature of this invention, a paper shelf 18 is provided between the upper case portion 2 and the cover 3 to separate the printed paper portion from the unprinted portion. The paper shelf 18 is rotatably and removably supported at one end 19 in the vicinity of the opening 14. The end 19 of the paper shelf 18 has a substantially tubular portion 19*a* which is rotatably supported on a shaft 20. The shaft 20 is substantially rectangular in cross section, but has a pair of opposite cross-sectional edges which are rounded to enable the smooth rotation of the tubular portion 19*a* about the shaft 20. The tubular portion 19*a* has a slit 19*b* which is slightly larger in width than the shaft 20, so that the paper shelf 18 can be disconnected from the shaft 20 or reconnected thereto when it is in a substantially upright position. The end 19 of the paper shelf 18 is located inwardly of the adjacent end of the cover 3, and the cover 3 and the paper shelf 18 define therebetween only a very narrow clearance which is sufficiently wide for the paper 13 to pass.

Figure 4:
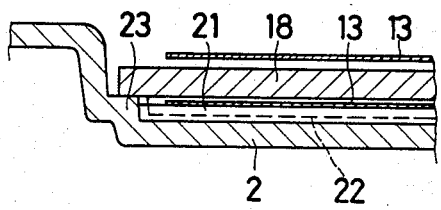
FIG. 4 is an enlarged sectional view taken along the line IV—IV of FIG. 1.

The paper shelf 18 has a lower surface facing the top surface of the upper case portion 2. The top surface of the upper case portion 2 has a pair of projections 21 facing the paper shelf 18 and extending transversely of the paper 13. The lower surface of the paper shelf 18 has a similar projection 22 extending in parallel to the projections 21 on the case portion 2 and situated approximately midway between the projections 21. The paper shelf 18 has a pair of lateral edges resting on shoulders 23 formed on the upper case portion 2, as shown in FIG. 4. The projections 21 on the case portion 2 are slightly spaced apart from the lower surface of the paper shelf 18, while the projection 22 of the paper shelf 18 is likewise slightly spaced apart from the top surface of the upper case portion 2. The projection 22 has a lower extremity lying at a level below the upper extremity of each of the projections 21, as shown in FIG. 1.

Figure 2:
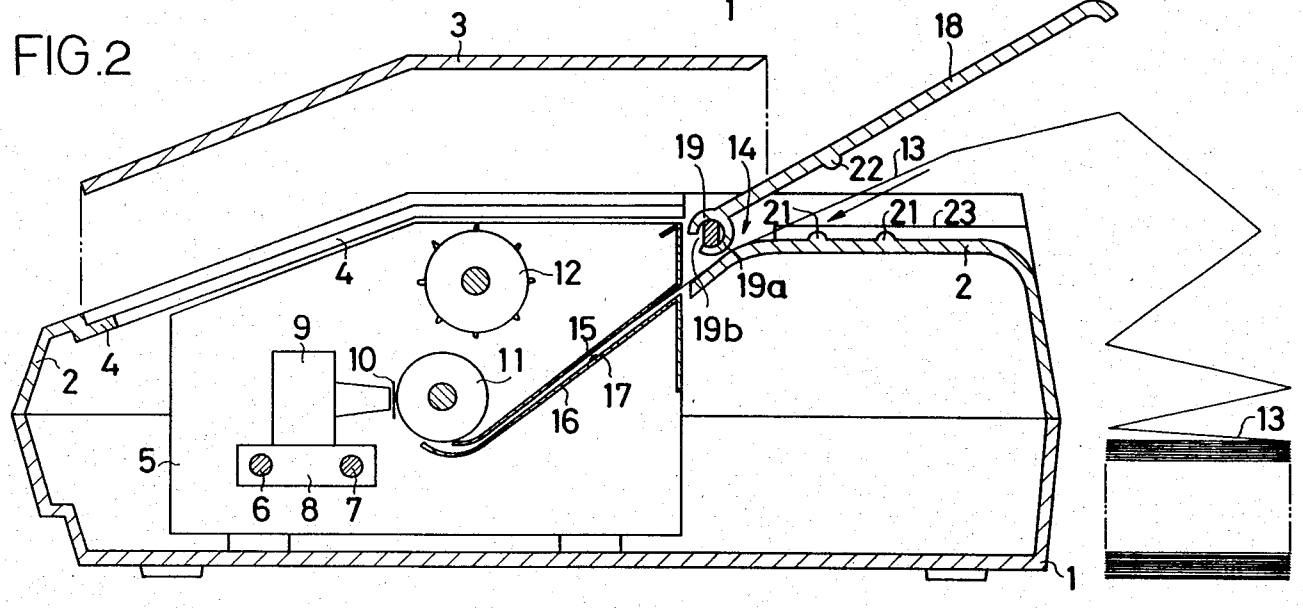
FIG. 2 is a view similar to FIG. 1, but showing the case in its open position which enables recording paper to be set therein.

The cover 3 is removable, and the paper shelf 18 is rotatable about its end 19, as shown in FIG. 2, in order to enable the recording paper 13 to be set in position. Alternatively, the paper shelf 18 can be turned upright and disconnected from the shaft 20 when the paper 13 is set. The paper 13 is set so that it may extend through the opening 14 between the upper case portion 2 and the paper shelf 18 and the passage 17 between the guide members 15 and 16, about the platen 11 and the pin wheel 12, and through the opening 14 between the cover 3 and the paper shelf 18, as shown in FIG. 1. As the printing operation proceeds, the paper 13 is fed forward by the pin wheel 12.

As is obvious from the foregoing description and the drawings, the paper shelf 18 and the projections 21 and 22 substantially close the opening 14, except for the very narrow clearances provided on both sides of the enlarged end 19 of the paper shelf 18 for enabling the passage of the paper 13. The paper 13 is held in a somewhat curved shape between the projections 21 and 22, while it is slidable past the projections 21 and 22. Thus, the noise produced during the printing operation is virtually completely confined within the case by the cooperation of the paper shelf 18, the projections 21 and 22 and the curved paper portion therebetween, and hardly leaks out. The friction which develops between the paper 13 and the projections 21 and 22 imparts an appropriate amount of tension to the paper 13 in the passage 17 to prevent its vibration which has heretofore been another source of noise.

Figure 5:
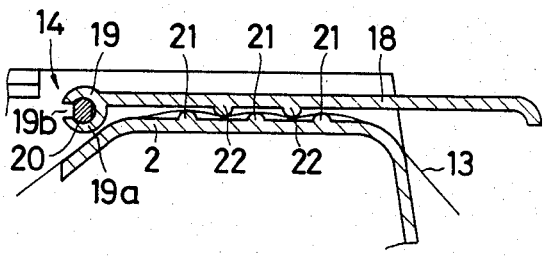
FIG. 5 is a fragmentary view similar to a portion of FIG. 1, but showing a modified structure.

The invention has been described with reference to a preferred embodiment thereof. It is, therefore, to be understood that variations or modifications may be easily made by anybody of ordinary skill in the art without departing from the scope of this invention which is defined by the appended claims. For example, it is possible to increase the number of the projections 21 and 22 as shown by way of example in FIG. 5. Alternatively, it would sometimes be sufficient to provide each of the upper case portion 2 and the paper shelf 18 with only one projection. It would also be all right if the weight of the paper shelf 18 causes the projection 22 to contact the upper case portion 2. This construction contributes to a further reduction in the leakage of noise. Moreover, the paper shelf 18 does not necessarily need to be removable.

What is claimed is:

1. A printer housing comprising: a case body which is partly open at its top and which is dimensioned to accommodate therein a printer mechanism having a printing head; a cover for said case body; said case body having a top surface which is spaced below one end of said cover, said top surface and said one end of said cover thereby defining therebetween an opening through which a paper to be printed is moved into said case body for printing by the printing head, and out of said case body after printing; a paper shelf lying over said top surface of said case body and pivotably supported at one end for pivotal movement away from said top surface, said one end of said paper shelf being located in the vicinity of said opening and spaced slightly apart from said top surface and said cover; said top surface having at least one projection extending transversely of said paper; and said paper shelf having a lower surface facing said top surface and formed with at least one projection extending transversely of said paper and spaced apart from said projection on said top surface longitudinally of said paper, said projection of said paper shelf having a lower extremity lying at a level below the upper extremity of said projection of said top surface.

2. A printer housing as set forth in claim 1, wherein said paper shelf is removable.

3. A printer housing as set forth in claim 2, wherein at least two projections are formed on one of said top and lower surfaces, said projection on the other of said surfaces being located between said two projections.

4. A printer housing as set forth in claim 3, wherein said projection or projections on said case body are slightly spaced apart from said bottom surface of said paper shelf, while said projection or projections of said paper shelf are slightly spaced apart from said top surface of said case body.

5. A printer housing as set forth in claim 2, wherein said paper shelf is provided at said one end thereof with a tubular portion supported rotatably on a shaft, said tubular portion being removable from said shaft.

6. A printer housing as set forth in claim 1, wherein said cover is removable from said case body.

7. A printer housing as set forth in claim 1, wherein at least two projections are formed on one of said top and lower surfaces, said projection on the other of said surfaces being located between said two projections.

8. A printer housing as set forth in claim 1, wherein said projection or projections on said case body are slightly spaced apart from said bottom surface of said paper shelf, while said projection or projections of said paper shelf are slightly spaced apart from said top surface of said case body.

9. A printer housing as set forth in claim 1, wherein said paper shelf is provided at said one end thereof with a tubular portion supported rotatably on a shaft, said tubular portion being removable from said shaft.

* * * * *